US007603863B2

(12) United States Patent
Widener et al.

(10) Patent No.: US 7,603,863 B2
(45) Date of Patent: Oct. 20, 2009

(54) SECONDARY FUEL INJECTION FROM STAGE ONE NOZZLE

(75) Inventors: Stanley Kevin Widener, Greenville, SC (US); Lewis Berkley Davis, Jr., Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 661 days.

(21) Appl. No.: 11/422,123

(22) Filed: Jun. 5, 2006

(65) Prior Publication Data

US 2007/0277531 A1 Dec. 6, 2007

(51) Int. Cl.
*F02C 3/16* (2006.01)

(52) U.S. Cl. ..... 60/735; 60/736; 60/746; 60/806; 60/740; 60/39.54; 415/114

(58) Field of Classification Search ..... 60/736, 60/746, 806, 39.54, 735, 740; 415/114
See application file for complete search history.

(56) References Cited

U.S. PATENT DOCUMENTS

| | | | | |
|---|---|---|---|---|
| 2,479,777 | A * | 8/1949 | Price | 60/765 |
| 4,534,165 | A | 8/1985 | Davis, Jr. et al. | |
| 5,077,967 | A | 1/1992 | Widener et al. | |
| 5,154,060 | A | 10/1992 | Walker et al. | |
| 5,220,795 | A | 6/1993 | Dodds et al. | |
| 5,423,175 | A | 6/1995 | Beebe et al. | |
| 5,487,275 | A | 1/1996 | Borkowicz et al. | |
| 5,575,146 | A | 11/1996 | Borkowicz et al. | |
| 5,685,139 | A | 11/1997 | Mick et al. | |
| 6,089,025 | A | 7/2000 | Tekriwal et al. | |
| 6,205,765 | B1 | 3/2001 | Iasillo et al. | |
| 6,250,063 | B1 | 6/2001 | Davis, Jr. et al. | |
| 6,622,488 | B2 * | 9/2003 | Mansour et al. | 60/740 |
| 6,722,135 | B2 | 4/2004 | Davis, Jr. et al. | |
| 6,810,655 | B2 | 11/2004 | Davis, Jr. et al. | |
| 6,868,676 | B1 | 3/2005 | Haynes | |
| 6,951,108 | B2 | 10/2005 | Burrus et al. | |
| 6,993,916 | B2 | 2/2006 | Johnson et al. | |
| 7,007,477 | B2 | 3/2006 | Widener | |
| 2003/0024234 | A1 * | 2/2003 | Holm et al. | 60/39.463 |
| 2005/0268615 | A1 | 12/2005 | Bunker et al. | |
| 2005/0268616 | A1 | 12/2005 | Widener | |
| 2005/0268618 | A1 | 12/2005 | Johnson et al. | |
| 2006/0042255 | A1 | 3/2006 | Bunker et al. | |

* cited by examiner

*Primary Examiner*—Michael Cuff
*Assistant Examiner*—Craig Kim
(74) *Attorney, Agent, or Firm*—Sutherland, Asbill & Brennan LLP

(57) ABSTRACT

A secondary combustion system for a stage one turbine nozzle. The secondary combustion system may include a supply tube extending into the stage one nozzle, a number of injectors extending from the supply tube to an outer surface of the stage one nozzle, and an air gap surrounding each of the number of injectors.

8 Claims, 1 Drawing Sheet

SECONDARY FUEL INJECTION FROM STAGE ONE NOZZLE

TECHNICAL FIELD

The present application relates generally to gas turbine engines and more particularly relates to a secondary fuel injection system positioned about the stage one nozzles.

BACKGROUND OF THE INVENTION

One method used to lower overall $NO_X$ emissions in a gas turbine engine is to minimize the reaction zone temperature below the level at which $NO_X$ emissions are formed. For example, commonly owned U.S. Pat. No. 6,868,676 to Haynes, entitled "Turbine Containment System and Injector Therefore", shows the use of a secondary combustion system downstream of the primary combustion system. This secondary combustion system includes a number of injectors to inject fuel and other fluids at the head end of the combustor. The fuel burns quickly due to the high temperature environment and relieves the temperature of combustor head end so as to lower overall $NO_X$ emissions. U.S. Pat. No. 6,868,676 is incorporated herein by reference.

Although testing of this secondary combustion system has shown promise in reducing overall $NO_X$ emissions, such a system has not been widely adopted because of a concern with the durability of the fuel injectors. Specifically, the fuel injectors are positioned within the hot gas pathway. Any loss of cooling to the injectors therefore may result in the failure of the injectors and possible damage to the turbine as a whole.

There is a desire therefore for an improved secondary combustion system. Such a system should promote lower $NO_X$ emissions while also being durable and reliable.

SUMMARY OF THE INVENTION

The present application thus describes a secondary combustion system for a stage one turbine nozzle. The secondary combustion system may include a supply tube extending into the stage one nozzle, a number of injectors extending from the supply tube to an outer surface of the stage one nozzle, and an air gap surrounding each of the number of injectors.

A pair or a number of pairs of the injectors may branch off of the supply tube. The injectors may be flush with the outer surface of the stage one nozzle. The injectors may be positioned about a leading edge of the stage one nozzle. The injectors may be positioned on the outer surface of the stage one nozzle at an angle. The air gap is in communication with a cooling cavity of the stage one nozzle. The injectors provide a flow of fuel and the air gap provides a flow of air.

A further embodiment of the present application describes a secondary combustion system. The secondary combustion system may include a stage one nozzle, a supply tube extending into the stage one nozzle, a number of injectors extending from the supply tube to an outer surface of the stage one nozzle, and an air gap surrounding each of the injectors.

A pair of the injectors may branch off of the supply tube. The injectors may be flush with the outer surface of the stage one nozzles. The injectors are positioned about a leading edge of the stage one nozzle. The injectors are positioned on the outer surface of the stage one nozzle at an angle. The air gap is in communication with a cooling cavity of the stage one nozzle. The injectors provide a flow of fuel and the air gap provides a flow of air.

The present application further describes a method of reducing $NO_X$ emissions in a gas turbine engine. The method may include combusting a primary stream of fuel and a primary stream of air to create a hot gas stream, flowing the hot gas stream towards a number of stage one nozzles, flowing a secondary stream of fuel and a secondary stream of air from the number of stage one nozzles, and combusting the secondary stream of fuel and the secondary stream of air so as to lower the temperature of the hot gas stream. The secondary stream of air surrounds the secondary stream of fuel.

These and other features of the present application will become apparent to one of ordinary skill in the art upon review of the following detailed description when taken in conjunction with the several drawings and the appended claims.

DETAILED DESCRIPTION

Figure 1:
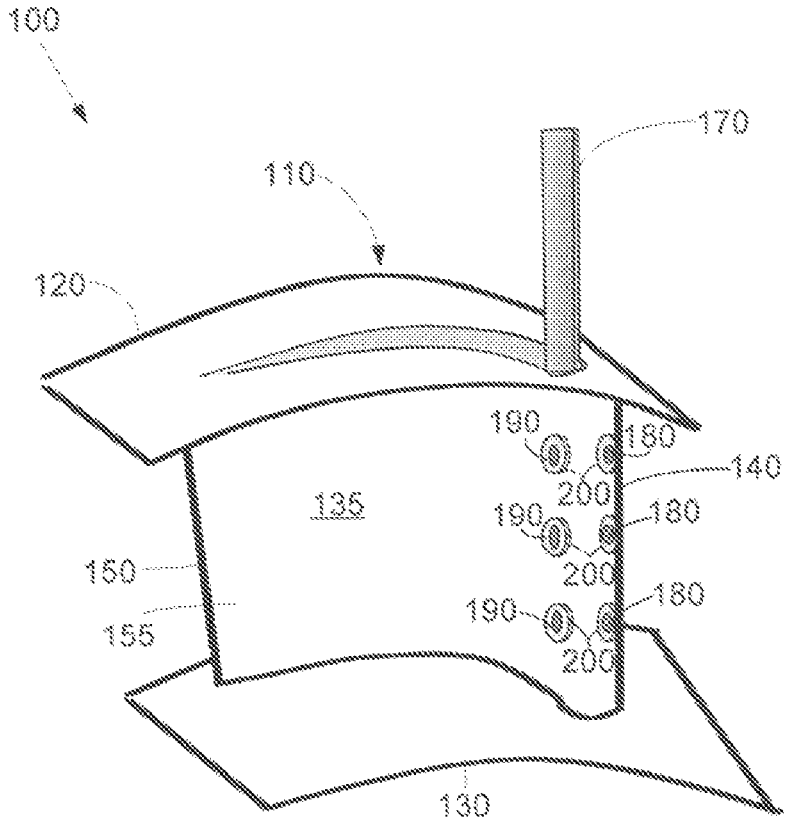
FIG. 1 is a perspective view of a stage one nozzle with the secondary combustion system as is described herein.
Figure 2:
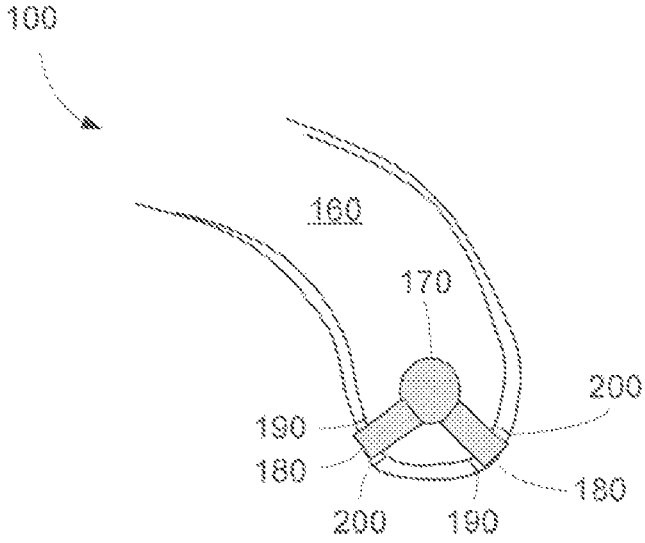
FIG. 2 is a top cross-sectional view of the stage one nozzle and the secondary combustion system of FIG. 1.

Referring now to the drawings, in which like numerals refer to like elements throughout the several views, FIGS. 1 and 2 show a secondary combustion system 100 as is described herein. The secondary combustion system 100 is positioned within some or all of the stage one nozzles 110, one of which is shown in FIGS. 1 and 2. The stage one nozzles 110 are the nozzles closest to the combustor and the primary combustion system. Each stage one nozzle includes an outside diameter 120 and an inside diameter 130. Each stage-one nozzle 110 also includes an airfoil 135 having a leading edge 140, a trailing edge 150 and an outer surface 155. A cooling cavity 160 extends within the stage one nozzle 110.

The secondary combustion system 100 includes a supply tube 170. The supply tube 170 enters the stage one nozzle 110 from the outside diameter 120 and extends into the cooling cavity 160. The supply tube 170 leads to a number of injectors 180. As is shown in FIG. 2, the individual injectors 180 branch off from the supply tube 170. Any number of injectors 180 may be used. The injectors 180 extend from the supply tube 170 to a number of apertures 190 positioned along the body of the airfoil 135. The injectors 180 are largely flush with the outer surface 155 and the apertures 190. The injectors 180 and the apertures 190 may be positioned at an angle to the stagnation streamlines as is shown or they may be positioned directly counter to the streamlines. Positioning of the injectors 180 is determined so as to provide the best mixing and combustion as well as providing protection to the stage one nozzle 110 itself from the hot combustion gases. As such, other orientations may be used herein.

The injectors 180 and the apertures 190 are sized such that an air gap 200 extends between the injector 180 and the perimeter of the aperture 190. The air gap 200 provides a passageway to the cooling cavity 160 of the stage one nozzle 110. The air gap 200 accommodates thermal and stuck up positional tolerances as well as provides a concentric jet of air to mix immediately with the fresh fuel prior to combustion. The jet of cooling air both shield the injectors 180 and mixes with the fuel stream.

In use, the injectors 180 receive a small portion of the total fuel injected into the turbine as a whole. Fuel passes through the supply tube 170 and the injectors 180 into the hot gas path. Likewise, air passes through the cooling cavity 160 and the air gaps 190. As described above, the fuel burns quickly due to the high temperature environment. Because the small portion of the fuel thus burned would otherwise be burned in the combustor head end, the injection of this fuel through the stage one nozzles 110 reduces the temperature at the combustor head-end so as to lower the overall $NO_X$ emissions. The fuel thus injected through the injectors 180 and burned also reaches the turbine quickly and is expanded to lower temperature and pressure, thereby reducing the residence time of the overall burned fuel-air mixture at the maximum turbine firing temperature and reducing $NO_x$ emissions.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A secondary combustion system for a stage one turbine nozzle, comprising:

a supply tube extending into the stage one nozzle;

a plurality of injectors extending from the supply tube to an outer surface of the stage one nozzle; and an air gap surrounding each of the plurality of injectors about the outer surface of the stage one nozzle.

2. The secondary combustion system of claim 1, wherein a pair of the plurality of injectors branches off of the supply tube.

3. The secondary combustion system of claim 2, wherein a plurality of pairs branches off of the supply tube.

4. The secondary combustion system of claim 1, wherein the plurality of injectors are flush with the outer surface of the stage one nozzle.

5. The secondary combustion system of claim 1, wherein the plurality of injectors is positioned about a leading edge of the stage one nozzle.

6. The secondary combustion system of claim 1, wherein the plurality of injectors is positioned on the outer surface of the stage one nozzle at an angle.

7. The secondary combustion system of claim 1, wherein the air gap is in communication with a cooling cavity of the stage one nozzle.

8. The secondary combustion system of claim 1, wherein the plurality of injectors provides a flow of fuel and the air gap provides a flow of air.

* * * * *